United States Patent [19]

Rosenbloom

[11] 4,117,854

[45] Oct. 3, 1978

[54] ELECTRIC MANICURE

[76] Inventor: William J. Rosenbloom, 8 Pioneer Rd., Westport, Conn. 06880

[21] Appl. No.: 776,295

[22] Filed: Feb. 10, 1977

[51] Int. Cl.[2] ..... A45D 29/05

[52] U.S. Cl. ..... 132/75.8

[58] Field of Search ..... 132/75.6, 75.8, 76.4, 132/73.6; 51/358, 172, 128, 170; D8/61

[56] References Cited

U.S. PATENT DOCUMENTS

| | | | |
|---|---|---|---|
| 1,604,720 | 10/1926 | Pfluntzer | 132/75.8 |
| 1,719,064 | 7/1929 | Lidseen | 132/73.6 |
| 1,915,304 | 6/1933 | Gallagher | 132/75.8 |
| 2,923,303 | 2/1960 | Hundt | 132/75.8 |
| 3,311,117 | 3/1967 | Thompson | 132/73.6 |

*Primary Examiner*—G. E. McNeill
*Attorney, Agent, or Firm*—Alphonse R. Noë

[57] ABSTRACT

An electric manicure includes a hand-held or table-supported housing enclosing a motor and a power-driven grinding disc for fingernail trimming. A touch-plate having a slot-like opening for insertion of a fingernail forms part of the housing enclosure in proximity to the grinding disc. The touch-plate is yieldably movable towards the grinding disc, against biasing spring pressure, under the force of the finger thereon which also causes the fingernail to protrude into the slot beyond the flesh part of the fingertip. The extent of advance of the touch-plate and its spacing from the grinding disc are controllably adjustable through a lever and cam to permit preselection of fingernail trim length. Orientation of the slot in relation to the grinding disc permits a wide variety of trimming procedures. The disc may be provided with fingernail buffing means on its circumference.

7 Claims, 4 Drawing Figures

ELECTRIC MANICURE

BACKGROUND OF THE INVENTION

1. Field of the Invention

This invention relates to manicuring devices and more particularly to an electric motor driven manicuring device for automatically trimming fingernails to any predetermined desired length while, at the same time, avoiding any possibility of abrading the fingertip.

2. Description of the Prior Art

Automatic nail files and electric manicuring machines of various types have been suggested by the prior art. However, it does not appear that an electric manicuring device providing safe, effective nail trimming, simplicity of use and operation, economy of manufacture and widespread consumer acceptance has been achieved.

U.S. Pat. No. 1,915,305 to Gallagher discloses a manicuring device suitable for asembly on a dentist's handpiece or drill chuck and comprising a grinding disc located within a guard having several openings for the insertion of fingernails. U.S. Pat. No. 3,754,556 to Watkins states that there are a number of disadvantages associated with the Gallagher device since the unyielding grinding disc tends to blunt manicured fingernails. The patentee Watkins proposes to overcome this by providing flexible nail filing means such as textured endless belts rotating within a housing into which fingernails may be inserted.

U.S. Pat. No. 3,596,667 to Burecklin discloses an electrically driven fingernail trimmer utilizing a rotating emery wheel upon a boss mounted on the driving motor housing with the boss extending sidewardly arcuately downwardly and inwardly to the housing so as to permit a finger to be placed flat on the housing top leaving the fingernail exposed on the boss top for trimming while the fingertip flesh is brought to bear protectedly against the boss side surface. U.S. Pat. No. 2,210,267 to Smith discloses a mechanically complex, electrically operated fingernail trimming machine utilizing a cutter guide and a plurality of rotatable cutters which trim a fingernail in accordance with a predetermined shape selected prior to actual operation of the cutting mechanism.

U.S. Pat. No. 2,923,303 to Hundt discloses a powered fingernail file in which a plate-like guide overlies a rotating abrasive wheel. The guide has a concave surface at its end and is resiliently slidable relative to the wheel and is provided with means to dampen its resilient motion. The patentee states that the spring mounted finger guide facilitates controlled filing and protects fingers from damage. In U.S. Pat. No. 3,311,117 to Thompson it is stated that various prior art expedients in the form of guards and finger rests to keep the finger from moving out of a desired relative position with a driven abrasive disc unduly limits access to the abrasive area and interferes with full usability of the abrasive action on the fingernail. The patentee suggests a device having a rotatable head with an abrasive end face and an axial bore in which is slidably mounted a plunger extending from the end face and retractable axially inward from an outer limit position. Resilient means urge the plunger towards its outer limit position while the plunger may be depressed to an inner limit position which provides a minimum safe spacing of the finger placed thereon to avoid abrasive action on the flesh of the finger when manicuring the fingernail by the abrasive action of the end face.

Thus, the prior art exhibits many and varied attempts at providing an electrically powered device for filing fingernails. However, these various prior art devices are primarily specific as to one type of use and limited to overcoming a particular disadvantage so that other drawbacks nevertheless remain. Moreover, there has not been a commercial acceptance of such devices equivalent to that which one would expect of a labor saving electrically powered machine. Accordingly, the need for an automatic fingernail trimming device which is economical to manufacture, simple to use and possesses a potential for consumer acceptance exists.

SUMMARY OF THE INVENTION

Certain disadvantages associated with the prior art devices, as typified by the patents discussed above, are overcome according to my invention which provides an electric manicure device for automatically filing nails to any desired length, while, at the same time, avoiding any possibility of abrading the finger tip. The electric manicure device of my invention avoids the use of complex mechanical interarrangements to achieve predetermined fingernail trim length while at the same time enclosing all operative parts in a convenient to use housing which may be hand-held or placed on a tabletop or similar surface so as to avoid any consumer reluctance to use the device. Moreover, the electric manicure device of my invention has a minimum of moving parts so that manufacture, assembly and maintenance are comparatively easy and economical and operation is essentially trouble-free.

The foregoing is achieved, according to my invention, through the provision of a housing or a casing which encloses a grinding means for grinding fingernails for trimming and a motor for powering the grinding means for motion relative to a fingernail such as by rotation, vibration and the like. A touch-plate, having a concave depression upon which the finger having the nail to be trimmed rests, has a slot-like opening and forms a portion of the housing enclosure in proximity to the grinding face of the grinding means. The touch-plate is spaced apart from the grinding means through the urging of biasing means such as springs but is yieldably movable towards the grinding means under pressure of the finger.

The biasing means are of sufficient rigidity that they resist the pressure of the finger so that when the finger presses on the touch-plate at the appropriate position, the fingernail protrudes in an opening or slot beyond the flesh part of the fingertip as much as feasible. The resistance of the biasing means is then overcome permitting the touch-plate to advance towards the grinding means for trimming of the fingernails. The extent of advance of the touch-plate towards the grinding means and the space between the two is controllably adjustable through a lever actuating a cam bearing against the touch-plate so that a fingernail length of predetermined dimension can be trimmed.

Advantageously, the grinding means can be a grinding disc the face of which has an abrasive material. In such case, the opening or slot in the touch-plate is advantageously located so that its center is near the hub of the grinding disc and its ends are proximate the periphery of the disc. In this manner, the fingernail can be filed at relatively high speed at the end of the disc and relatively low speed at the center so that a higher degree of control over the trimming operation can be achieved by the user. Furthermore, the direction of grinding at one end of the slot is perpendicular to the nail face and in a direction toward the fingertip while it is away from the fingertip at the other end. With this choice of grinding direction and the choice of grinding speed in the center of the slot where the direction of grinding is in line with the nail, a variety of trimming procedures can be obtained.

In a further embodiment of my invention, the grinding means such as a grinding disc can be provided with buffing means on its circumference and a portion of the housing provided with an opening for access to this buffing means for buffing fingernails so that an additional use of the electric manicuring device can be obtained.

Accordingly, a feature of my invention is the provision of an electric manicuring device for automatically trimming fingernails to a predetermined desired length without abrading the fingertips.

A further feature of my invention is the provision of an electric manicuring device in which the grinding means is entirely enclosed in a housing and a portion of the housing is provided with an opening for inserting the fingernail for contact with the grinding means and this portion is controllably, adjustably positionable with respect to the grinding means so that it may be spaced therefrom according to a preselected value for determining the length of the fingernail after trimming.

Yet another feature of my invention is the provision of an electric manicuring device in which a finger rest facilitating insertion of the fingernail for contact with a grinding means is yieldably biased to project the fingernail beyond the trip of the finger and to advance towards the grinding means for trimming to a predetermined length without abrading the fingertip.

BRIEF DESCRIPTION OF THE DRAWINGS

The foregoing and other features, advantages and objects of my invention will be further apparent from the following description of a preferred embodiment thereof taken into conjunction with the accompanying drawings in which.

DESCRIPTION OF THE PREFERRED EMBODIMENT

Figure 1:
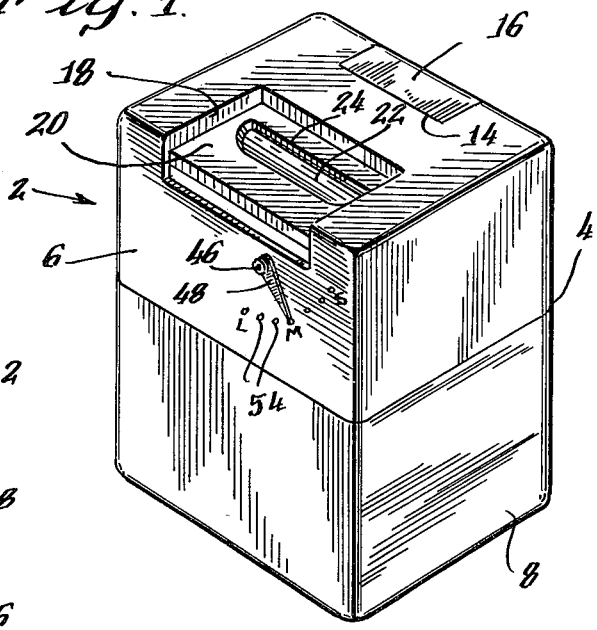
FIG. 1 is a top and front perspective view of an electric manicuring device according to an embodiment of my invention.
Figure 2:
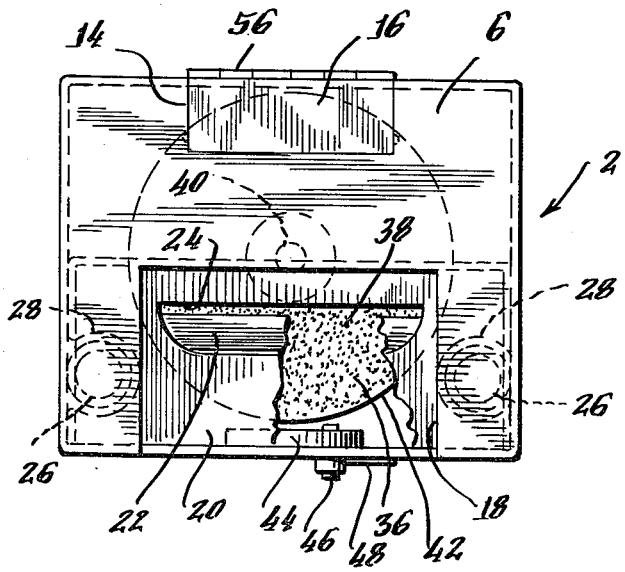
FIG. 2 is a top view, partly in section to show the grinding means, of the electrical manicuring device of FIG. 1.
Figure 3:
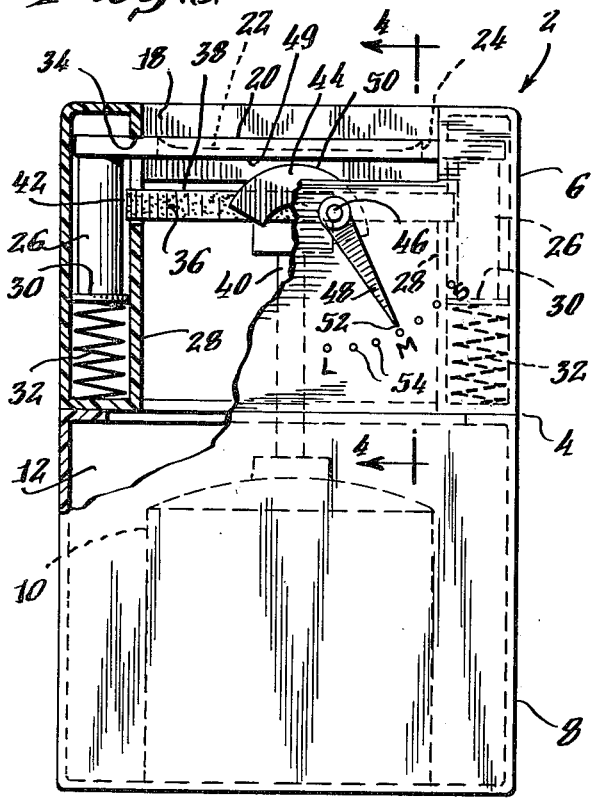
FIG. 3 is a front elevational view, partly in section to show the interior components, of the manicuring device of FIG. 1.

Referring to FIGS. 1, 2 and 3, there is shown an electric manicuring device 2 comprising a housing 4 including an upper portion 6 and a lower portion 8. The lower housing portion 8 contains a source of motive power referred to generally at 10 such as an electric motor and is provided with a space, indicated generally at 12, for receiving a energy source for the electric motor, such as batteries (not shown).

Figure 4:
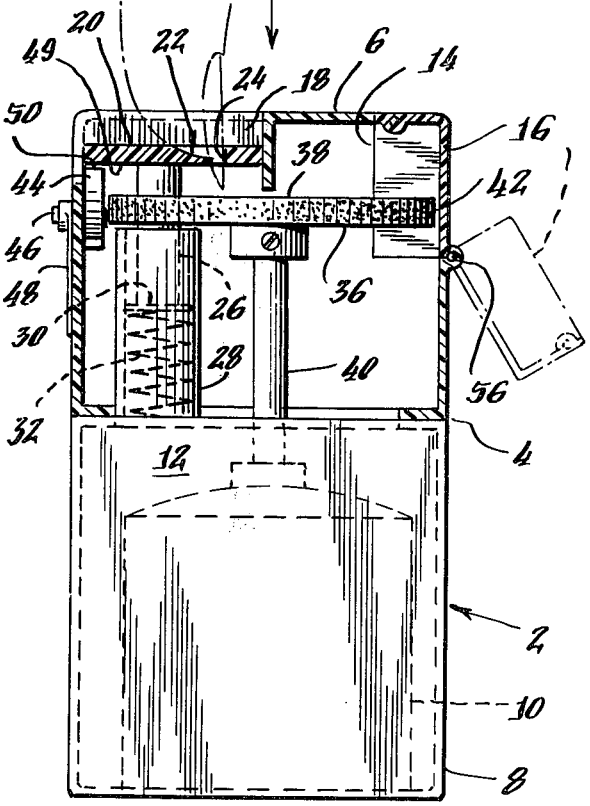
FIG. 4 is a side view, with a section taken along the line 4—4 of FIG. 3, of the electric manicuring device of FIG. 1.

The upper housing portion 6 includes an opening 14, seen best in FIG. 4, which is normally closed by the lid 16 unless used for the purpose which will be described in greater detail hereinafter. The upper housing portion 6 includes a further opening 18 in the forward portion thereof. Slideably positioned within this opening 18 is a touch-plate 20 containing a finger rest 22 having a concave arcuate shape to accommodate the tip of a finger inserted thereon as shown in FIG. 4. The finger rest 22 terminates in a slot-like opening 24 which provides communication with the interior of the upper housing portion 6.

The touch-plate 20 is attached to two pedestal supports 26 which are positioned within cylindrical guides 28 for piston-like reciprocal movement therein. The bottom surfaces 30 of the pedestal supports 26 contact the springs 32 which are positioned in the guides 28 with the result that the touch-plate 20 is urged upward to a point where its upper surface touches the sidewall of the housing opening 18 at the point shown at 34, as seen best in FIG. 3.

The springs 32 have sufficient rigidity so that when the fingertip is placed on the finger rest 22, as shown in FIG. 4, the touch-plate 20 is not urged downward by the pressure of the finger until the fingernail protrudes beyond the fingertip as much as possible. Continued pressure of the fingertip on the touch-plate 20 causes it to move downward against the yielding upward urging of the springs 32.

Located within the upper housing portion 6 is a fingernail grinding means shown as a disc 36, the upper surface of which is coated with an abrasive medium 38 suitable for the filing of fingernails. The disc 36 is attached to a shaft 40 which is caused to rotate by the motor 10 upon acutation of a switch either manually or as a consequence of the downward pressure on the touch-plate 20. While the disc 36 carries an abrasive medium 38 on its upper surface thereof, it may also carry a buffing medium on its circumferential edge, as shown at 42.

Positioned beneath the touch-plate 20 is a cam 44 which rotates about the pivot 46 and has attached to it a lever 48 for rotational movement of the cam to various positions. The cam 44 is positioned such that the bottom surface 48 of the touch-plate will rest on the cam upper surface 50 when the touch plate is urged downward by the pressure of a fingertip. The lever 48 has a tip 52 which can be positioned to various detents 54, as best seen in FIG. 3, for controllably adjusting the position of the cam. In this way, the cam upper surface 50 is placed closer or further from the bottom surface 48 of the touch-plate 20 with the result that the touch-plate travel downward is limited by the cam surface in an adjustable manner.

The manicuring device is operated to trim or file a fingernail by first presetting the desired nail length by adjusting the lever 48 of the cam 50 to any one of the detents 54 shown as having the lettering L, M, S for long, medium and short trims. This setting determines the spacing between the touch-plate 20 and the upper surface of the disc 36 at the limit of the touch-plate travel. For example, to shape the nail longer at the tip than at the edges, the cam 50 is first set at its long position and the fingernail in the slot 24 is pressed down against the upper surface of the disc 36 until the desired length is obtained at the tip, the cam is then adjusted to the short position and the operation repeated for the fingernail edges.

The fingertip is placed on the finger rest 42 so that the nail protrudes through the slot 24 into the space between the touch-plate 20 and the upper surface of the grinding disc 36, as seen best in FIG. 4 illustrating the fingernail position prior to complete advance of the touch-plate. After actuating the grinding disc the finger is pressed downward so that the touch-plate yieldingly moves downward toward the grinding disc. The fingernail contacts the upper surface of the grinding disc and is trimmed to the desired preset length. If it is desired to buff the surface of the fingernail, the lid 16, which is hingedly attached to the upper housing 6 by means of the hinge 56 is opened to expose the circumferential buffing surface 42 of the grinding disc in order to facilitate buffing.

Advantageously, the slot 24 in touch-plate 20 is positioned so that its center is near the hub of the rotating disc 36 and its ends are near the disc periphery. In this manner, the fingernail can be filed at relatively high speeds at the ends and at relatively low speeds at the center. Furthermore, the direction of grinding at one end of this slot is at right angles to the nail face and grinding is in a direction toward the fingertip while away from the fingertip at the other end. The direction of grinding at the center of the slot is in line with the fingernail. Thus, various positions within the slot itself can provide different types of grinding for the fingernail as may be desired by the user. In addition, the use of the slot 24 extending across the hub area to the periphery of the disc permits utilization of the total surface of the disc grinding surface and is more efficient and economical.

While I have shown a particular embodiment of my invention, it is to be understood that equivalents thereof will be apparent to those skilled in the art without departing from the spirit of my invention. Thus, the touch-plate 20 may contain several spaced-apart slots and the grinding disc surface 38 may be provided with different types of abrading medium so that beneath each such slot in the touch-plate 20 is a different abrading medium in order for coarse or fine grinding as the user may desire. In addition, while the grinding means is shown as a rotating disc 36 it could also be a moving belt or a reciprocating file. Moreover, the grinding disc 36 which is shown as mounted on a vertical shaft could be a wheel mounted on the horizontal shaft. Also, in the embodiment described herein the housing upper and lower portions, 6 and 8, are separable for access to the interior for cleaning and for changing the grinding disc or batteries. However, other equivalent means, such as hinged covers, may be provided to achieve the same result.

The touch-plate 20 can be made from a variety of materials. It can be molded from plastic and have the finger rest 22 molded therein. Alternately, the touch-plate 20 may be of a thin material, such as spring steel, to enable close trimming. In addition, the thin material may be somewhat resilient for extra close advance toward the grinding disc for closing trimming.

The housing 4 is shaped so that the entire unit 2 can stand upright on its base on a table-top or other surface to allow for filing in a fixed position. However, the unit can also be shaped to fit the hand for use in a portable fashion if desired.

Thus, there has been described an electric manicure for automatically trimming the fingernails to a predetermined desired length without abrading the fingertips while achieving advantages not theretofore obtained.

I claim:

1. An electric manicuring device for automatically trimming the fingernails to a predetermined desired length without abrading the fingertips comprising a housing, grinding means located within the housing for grinding fingernails for trimming, the grinding means presenting a substantially flat face to and being movably powered for motion relative to a fingernail placed in contact therewith for grinding the fingernail, electric motor means located within the housing for powering the grinding means, touch-plate means for receiving the finger having the fingernail to be trimmed, the touch-plate means forming part of the housing and being positioned adjacent to but spaced from the grinding means, the touch-plate means having an opening therein providing communication with the grinding means for inserting the fingernail, the touch-plate means being yieldingly mounted on biasing means for biasing the touch-plate away from the grinding means, the biasing means being such that it yields under pressure of the finger to permit the touch-plate means to advance toward the grinding means to enable contact between the face of the grinding means and the fingernail to be trimmed, the touch-plate means and grinding means being adjustably spaced from one another, means for controllably varying the spacing between the touch-plate means and the grinding means after advance of the touch-plate means under pressure of the finger and setting the spacing to a preselected value determining the length of the fingernail after grinding by the grinding means.

2. An electric manicuring device as claimed in claim 1 wherein the grinding means is a rotating grinding disc having abrasive means on its face and the opening in the touch-plate means is a narrow slot having its center positioned in proximity to the hub of the disc and its ends extending substantially to the periphery of the disc.

3. An electric manicuring device as claimed in claim 1 wherein the biasing means are sufficiently resistant to yielding so that the fingernail protrudes into the opening in the touch-plate means in a manner such that the fingernail protrudes beyond the tip of the finger before the pressure by the finger advances the touch-plate means.

4. An electric manicuring device as claimed in claim 1 wherein the grinding means is a rotating grinding disc having abrasive means on its face and a fingernail buffing means on its circumferential edge surface and the housing has an opening in proximity to the buffing means to provide access thereto for buffing of fingernails.

5. An electric manicuring device as claimed in claim 1 wherein the touch-plate means is secured to pedestal means slidably mounted in guide means for reciprocal movement, spring biasing means contact the pedestal means to yieldingly urge the touch-plate means away form the grinding means, the spring biasing means providing sufficient resistance to yielding to ensure that the fingernail of a finger received on the touch-plate means projects beyond the fingertip into the opening in the touch-plate means, the resistance being such that the touch-plate means will advance toward the grinding means under the pressure of the finger thereon, controllably adjustable stop means for contacting the touch-plate means when it has advanced toward the grinding means a predetermined distance to provide a desired spacing for the trimming of the fingernail to a preselected length.

6. An electric manicuring device as claimed in claim 2 wherein the touch-plate means includes a concave depression adjacent the slot to receive the fingertip and assure that only the fingernail is inserted through the slot.

7. An electric manicuring device as claimed in claim 5 wherein the controllably adjustable stop means is a cammedsurface means contacting the touch-plate means when the touch-plate means reaches its limit of travel.

* * * * *